US008230876B2

(12) United States Patent
Gunnarsson et al.

(10) Patent No.: US 8,230,876 B2
(45) Date of Patent: Jul. 31, 2012

(54) APPARATUS FOR HANDLING A HOSE

(75) Inventors: Johan Gunnarsson, Malmo (SE); Annika Birkler, Malmo (SE)

(73) Assignee: Dresser, Inc., Addison, TX (US)

( * ) Notice: Subject to any disclaimer, the term of this patent is extended or adjusted under 35 U.S.C. 154(b) by 397 days.

(21) Appl. No.: 11/784,638

(22) Filed: Apr. 9, 2007

(65) Prior Publication Data

US 2008/0000528 A1 Jan. 3, 2008

(30) Foreign Application Priority Data

Apr. 11, 2006 (EP) ..... 06112475

(51) Int. Cl.
*B65H 75/34* (2006.01)
*A62C 33/00* (2006.01)
*B67D 7/40* (2010.01)

(52) U.S. Cl. ..... 137/355.23; 137/355.27; 222/530; 222/533; 222/538

(58) Field of Classification Search ..... 137/355.16, 137/355.2, 355.23, 355.19, 355.27, 355.12; 222/527, 530, 533, 538
See application file for complete search history.

(56) References Cited

U.S. PATENT DOCUMENTS 1,893,972 A * 1/1933 Whitman ..... 222/36
2,150,025 A * 3/1939 Cook, Jr. et al. ..... 222/36
3,487,850 A * 1/1970 Rore et al. ..... 137/355.2
4,557,436 A * 12/1985 Drake ..... 242/372
6,328,060 B1 * 12/2001 Smith ..... 137/355.2
6,334,457 B1 1/2002 Baker, IV

FOREIGN PATENT DOCUMENTS

| | | | |
|---|---|---|---|
| DE | 8708333 | * | 6/1987 |
| EP | 1113979 | | 6/2002 |
| EP | 1331200 | A1 * | 7/2003 |
| EP | 1398294 | | 3/2004 |
| EP | 1243549 | | 6/2007 |
| EP | 1845057 | | 10/2007 |
| WO | WO 00/61490 | | 10/2000 |

OTHER PUBLICATIONS

European Patent Application No. 06112475: European Search Report dated Nov. 15, 2006, 1 page.

* cited by examiner

*Primary Examiner* — John Rivell
*Assistant Examiner* — Atif Chaudry
(74) *Attorney, Agent, or Firm* — Woodcock Washburn LLP

(57) ABSTRACT

An apparatus for handling a hose arranged in a hose housing. The hose is in successive order connected to a fuel supply connection, passes a first roll, passes a second roll and extends through an opening in the hose housing, towards a nozzle end of the hose. The first roll is attached to the housing by at least one resilient element and a first carrier part having the form of a swing lever, and the second roll is attached to the housing by at least a second carrier part, to allow extracting and retracting of the hose through the opening. Moreover, a method for handling a hose as well as a fuel dispensing unit are described.

19 Claims, 1 Drawing Sheet

APPARATUS FOR HANDLING A HOSE

CLAIM OF PRIORITY

This application claims priority under 35 USC § 119 to European Patent Application No. 06112475.6, filed on Apr. 11, 2006, which is now European Patent No. 1845057, issued on Aug. 20, 2008, the entire contents of which are hereby incorporated by reference.

TECHNICAL FIELD

The present invention relates to an apparatus and a method for handling a hose. The invention also concerns a fuel dispensing unit.

BACKGROUND

A fuel pump typically comprises a pump part standing on the ground, a display part positioned above the pump part and showing the chosen type of petrol, cash readout, volume readout etc, and a column to which one or more petrol hoses are connected.

When the tank of a vehicle is to be filled up, the driver parks the vehicle beside the petrol pump and opens the cover or cap of the vehicle's petrol tank. Then the driver selects the desired type of petrol and places the pump nozzle mounted at the end of the hose in the inlet of the vehicle's petrol tank and puts in the desired volume of petrol.

In some types of payment procedures, it is necessary to pay before filling-up can be started. For instance, charge card payment must in most cases be initiated by means of a card and code in an associated terminal before the pump is activated.

A difficulty that may arise in connection with filling-up is that the hose does not reach to the vehicle if parked a distance from the petrol pump. The reason why the vehicle has not been parked sufficiently close to the pump may be difficulty in maneuvering owing to a limited space round the petrol pump. It may also happen that the vehicle is first parked at a terminal for charge card payment. In that case the hose is usually not long enough and the driver must move the vehicle once more, which is time-consuming, so that it stands close to the petrol pump. To allow the hose to reach to the vehicle, it is usually necessary for the driver to park his vehicle so that the side of the vehicle where the filler cap is positioned faces the petrol pump. It is not always known to a driver of an unfamiliar vehicle whether the filler cap is positioned on the left or right side. This may result in the driver by mistake parking the vehicle on the wrong side of the pump and thus not being able to fill up the tank without moving the vehicle to the other side of the petrol pump since the hose does not reach all the way round the vehicle.

One way of facilitating access to the petrol pump is to provide it with a longer hose. This may, however, cause problems since a longer hose may tend to land on the ground when not used and thus get stuck in or be damaged by passing cars or other vehicles. To prevent this, the column may be provided with some kind of returning mechanism for the hose.

A problem common for hose returning devices is their size, or their extension within respective hose housings, which results in bulky structures.

SUMMARY

It is an object of the present invention to provide an improvement of the above techniques and prior art.

A particular object is to provide an apparatus for handling a hose, which is more simple in construction, more flexible and offers a quick modification of hose-returning forces.

These and other objects as well as advantages that will be apparent from the following description of the present invention are achieved by an apparatus, a fuel dispensing unit and by a method according to the description below.

Accordingly, a description is provided for an apparatus for handling a hose. The apparatus comprises a hose housing, a fuel supply connection, and, arranged in the housing, a first roll and a second roll, said hose housing has an opening for the hose, and the hose is in successive order connected to the fuel supply connection, passing by the first roll, passing by the second roll and extending through the opening towards a nozzle end of the hose. The first roll is attached to the housing by at least one resilient element and a first carrier part having the form of a swing (e.g., rotatable) lever, and the second roll is attached to the housing by at least a second carrier part, to allow extracting and retracting of the hose through the opening.

The inventive apparatus is highly advantageous in that it provides a flexible and quick way of adjusting the hose returning forces, simply by selecting a resilient element having an appropriate spring constant.

In one embodiment, the resilient element is either of a spring and an elastomeric string, which provides standardized, low-cost elastomeric elements.

In another embodiment, a first end of the resilient element is connected to the hose housing, and a second end of the resilient element is connected to either of the swing element and a support axle of the first roll, thereby providing a very smooth hose-returning force.

In yet another embodiment, the projection of the first roll on a horizontal plane is located between the projection of the hose opening on the horizontal plane and the projection of the point of rotation of the swing lever on the horizontal plane, thereby providing a very compact design and advantageous location of the first roll.

In still another embodiment, the first roll has a predetermined lowest position in an upper part or upper half of the hose housing, which also provides a very compact design and convenient access to the resilient member.

In a further embodiment, the carrier element is configured to support the swing lever. This configuration makes it possible to mount the two rollers and the lever on one assembly unit, thus making assembly of the apparatus more efficient.

The swing lever may be arranged to vary the distance between the first roll and the second roll, when extracting and retracting of the hose through the opening, for facilitating and improving the hose extraction and retraction capabilities.

Movement of the first roll may be independent of any movement of the second roll, when extracting and retracting of the hose through the opening, which facilitates smooth hose extraction/retraction.

The second carrier part may form an integral part of the hose housing, which provides for a more efficient manufacturing process.

In another embodiment, a first part of the hose is arranged between the fuel supply connection and the second roll, and a second part of the hose is arranged between the second roll and the nozzle end of the hose. The second part of the hose is, when the hose is in its retracted position, at least 30% longer than the first part of the hose. This proportion between the first and second part of the hose results in a very compact design, even if the maximum operating range of the hose is somewhat decreased. In one embodiment the second part of the hose is, when the hose is in its retracted position, at least 50% longer than the first part of the hose.

In another embodiment, the hose is arranged under the first roll and over the second roll, which facilitates a proper direction of the hose when it exits the hose housing.

According to another aspect of the invention there is provided a fuel dispensing unit for refueling vehicles, comprising at least one hose handling apparatus according to any one of the above described embodiments. The inventive fuel dispensing unit has the same advantages as the inventive apparatus.

According to another aspect of the invention there is provided a method for handling a hose arranged in a hose housing, said hose in successive order being connected to a fuel supply connection, passing a first roll, passing a second roll and extending through an opening in the hose housing, towards a nozzle end of the hose. The first roll is applying a return force on the hose and is attached to the housing by at least one resilient element and a first carrier part having the form of a swing lever, and the second roll is attached to the housing by at least a second carrier part (9), to allow extracting and retracting of the hose through the opening.

The inventive method may comprise any one of the embodiments of the apparatus described above, and may provide the same advantages as the inventive apparatus.

DESCRIPTION OF DRAWINGS

Embodiments of the present invention will now be described, by way of example, with reference to the accompanying schematic drawings, in which.

Like reference symbols in the various drawings indicate like elements.

DETAILED DESCRIPTION

Figure 1:
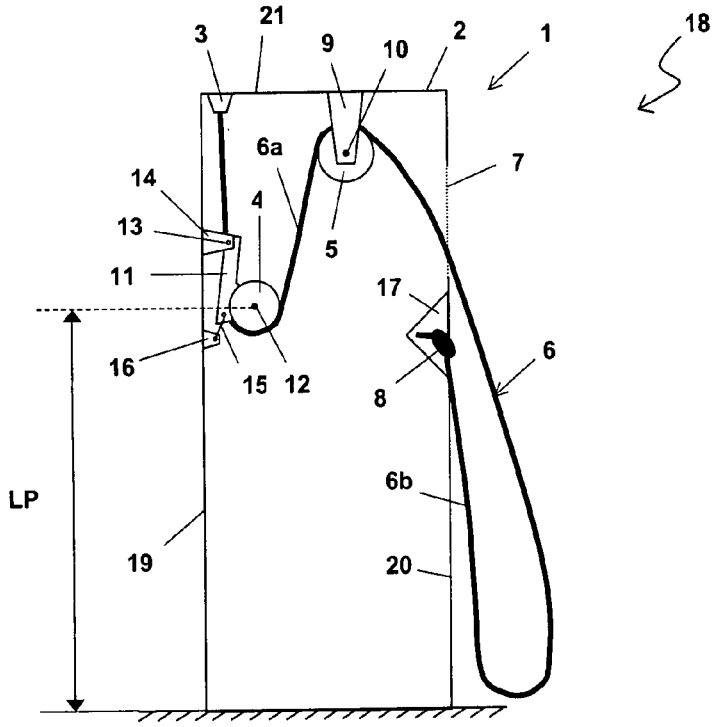
FIG. 1 is a schematic view of the apparatus when the hose is in its retracted position.

FIG. 1 illustrates an apparatus 1 for handling a hose 6 of a fuel dispensing unit 18. The apparatus 1 comprises a hose housing 2 having a front panel 20 and a back panel 19 joined by a top panel 21 and preferably two side panels. Arranged inside the housing 2 is a fuel supply connection 3, a first roll 4, and a second carrier part, or carrier element 9, supporting a second roll 5. The housing 2 has an opening 7 for the hose 6, and the hose 6 is in successive order connected to the fuel supply connection 3, passing under the first roll 4, passing over the second roll 5 and extending through the opening 7 towards a nozzle end 8 of the hose 6.

When the hose 6 is in its retracted position, as shown in FIG. 1, the nozzle end 8 of the hose 6 preferably rests in a nozzle boot 17.

The fuel supply connection 3 is preferably arranged above the uppermost position of the first roll 4, on or near the top panel 21 of the housing 2.

A first carrier part, or a swing lever 11, is connected to the housing 2 by a connection element 14, but may also be directly connected to a panel of the housing 2. When the hose 6 is extracted or retracted by a user, the swing lever 11 rotates about its axis of rotation, or about an axle 13 connecting the lever 11 to the connection element 14 or to the housing 2.

The first roll 4 is attached to the swing lever 11 by an axle 12 for allowing the first roll 4 to rotate when the hose 6 is extracted/retracted. An elastomeric element 15, which preferably is an elastomeric string, is at one end attached to the swing lever 11 or the axle 12 of the first roll 4, and is at its other end attached to the housing 2, preferably by a second connection element 16. Of course, the elastomeric string 15 may be directly connected to a panel of the housing 2 or to an integral part of the housing 2.

The connections between the elastomeric element 15 and the second connection element 16 as well as between the elastomeric element 15 and the swing lever 11 are conventional fasteners allowing fast connection and disconnection of the elastomeric element 15.

Figure 2:
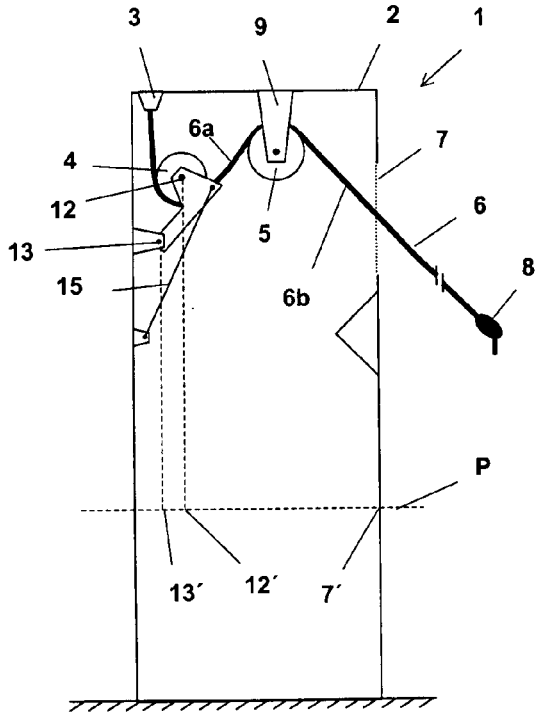
FIG. 2 is a schematic view of the apparatus when the hose is in its extracted position.

Preferably the axle 13, or the axis of rotation of the swing lever 11, is arranged opposite the hose opening 7 along a vertical direction, resulting in the first 4 and second 5 rolls being arranged therebetween as shown in FIG. 1. This is also shown in FIG. 2 where, for example, the projection of the first roll 4, or the projection of the axle of rotation 12', on a horizontal plane P, is located between corresponding projections 13' of the axle of rotation of the swing lever 11 and the projection 7' of the opening 7. Instead of a horizontal plane P, corresponding projections 13', 12' and 7' may be formed on a line having a horizontal direction from the back panel 19 towards the front panel 20.

The second roll 5 is connected to the carrier element 9 by an axle 10 and rotates when the hose 6 is extracted/retracted through the opening 7. It should be noted that the carrier element 6 may be an integral part of the housing 2, so that the second roll 5 may be directly connected to a panel of the housing 2. The second roll 5 may also be vertically and horizontally fixedly positioned in relation to the hose housing 2.

The hose 6 extends through the opening 7 and has a length allowing it, in its retracted position, to extend from the second roll 5 towards a position near the ground where it turns approximately 180° before it ends near the nozzle boot 17 where a nozzle end 8 of the hose 6 is located.

When the hose 6 is retracted, the first roll 4 is located at its lowermost position LP as indicated in FIG. 1, and when the hose 6 is extracted, the first roll 4 is located at its uppermost position as shown in FIG. 2. A first part **6*a* of the hose 6 extends, over the first roll 4, between the fuel supply connection 3 and the top of the second roll 5, and a second part 6*b* of the hose 6 extends between the top of the second roll 5 and the nozzle end 8 of the hose 6**.

It should be noted that the lowermost position LP of the hose 6 is in the upper part of the housing 2, and more preferably in the upper half of the housing.

When a user pulls the hose at the nozzle end, the swing lever 11 is rotated and the first roll 4 is lifted, and since the length of the hose 6 is constant, the first part **6*a* of the hose 6 becomes shorter as the second part 6*b* of the hose 6 becomes longer, which results in a longer effective range of a fuel dispensing nozzle arranged at the nozzle end 8 of the hose 6. During extraction and retraction, the first roll 4 exerts, via the swing lever 11 and the elastomeric element 15, a force on the hose which results in a retracting force (which may be towards the housing) retracting the hose 6 when the hose 6** is no longer pulled out.

The second roll 5 is preferably always located, along the vertical direction, above the first roll 4.

The axle 13 connecting the lever 11 may, of course, be integrated with the swing lever 11 or with the connection element 13, the axle 12 of the first roll 4 may be integrated with the first roll 4 or with the swing lever 11, and/or the axle 10 of the second roll 5 may be integrated with the second roll 5 or with the carrier element 9.

The connection element 13, the swing lever 11, and/or the carrier element 9 may comprise elongated slots for slidably holding a corresponding axle.

The swing lever 11 may have any geometric shape, and preferably comprises plates, such as steel plates.

In a preferred embodiment the carrier element 9 and the connection element 14 are integrated, and form a common steel plate that is readily mounted on the hose housing 6. The second connection element 16 may also be a part of said common steel plate.

More specifically, the opening 7 may be located anywhere along the front panel 20 or a front side of the housing 2, and the opening 7 may extend the full height of the housing 2. This would allow the second part 6*b* of the hose to at least partially rest inside the hose housing 2.

What is claimed is:

1. An apparatus for handling a hose in a fuel dispensing unit, said apparatus comprising:

a hose housing comprising an interior volume, a fuel supply connection, and a first roll and a second roll arranged in the hose housing, said hose housing having an opening for the hose, said hose in successive order being connected to the fuel supply connection, passing by the first roll, passing by the second roll and extending through the opening towards a nozzle end of the hose, wherein said first roll has a predetermined lowermost position in an upper half of the interior volume of the hose housing and is attached to the hose housing by at least one resilient element and a first carrier part having the form of a swing lever, and wherein a projection of the first roll on a horizontal plane is located between a projection of the hose opening on the horizontal plane and a projection of a point of rotation of the swing lever on the horizontal plane, said second roll being attached to the hose housing in a vertically and horizontally fixed position in relation to the hose housing by at least a second carrier part during extraction and retraction of at least a portion of the hose through the opening, wherein the first roll moves through an arcuate path during extraction and retraction of the portion of the hose through the opening.

2. An apparatus according to claim 1, wherein the resilient element is either of a spring and an elastomeric string.

3. An apparatus according to claim 1, wherein a first end of the resilient element is connected to the hose housing, and a second end of the resilient element is connected to either of the first carrier part and a support axle of the first roll.

4. An apparatus according to claim 1, wherein the second carrier part is an integral part of the hose housing.

5. An apparatus according to claim 1, wherein the swing lever is arranged to vary the distance between the first roll and the second roll, when extracting and retracting of the hose through the opening.

6. An apparatus according to claim 1, wherein movement of the first roll is independent of any movement of the second roll, when extracting and retracting of the hose through the opening.

7. An apparatus according to claim 1, wherein the second carrier part form an integral part of the hose housing.

8. An apparatus according to claim 1, wherein a first part of the hose is arranged between the fuel supply connection and the second roll, and a second part of the hose is arranged between the second roll and the nozzle end of the hose, the second part of the hose being, when the hose is in its retracted position, at least 30% longer than the first part of the hose.

9. An apparatus according to claim 1, wherein the hose is arranged under the first roll and over the second roll.

10. An apparatus according to claim 1, wherein a radius of the arcuate path is substantially equal to a length of the first carrier part.

11. An apparatus according to claim 1, wherein the first carrier part is coupled to a support axle of the first roll at a first location and the first carrier part is coupled to the housing at a second location, and wherein a radius of the arcuate path is substantially equal to a distance between the first and second locations.

12. A method for handling a hose arranged in a housing of a fuel dispensing unit for refueling vehicles, said hose being connected to a fuel supply connection, said method comprising:

guiding the hose by a first roll, the first roll having a predetermined lowermost position in an upper half of an interior volume of the housing ;

guiding the hose by a second roll which is fixedly positioned vertically and horizontally in relation to the housing; and extending the hose through an opening in the housing, towards a nozzle end of the hose;

applying a return force on the hose via the first roll, said first roll being attached to the housing by at least one resilient element and a first carrier part having the form of a swing lever; wherein a projection of the first roll on a horizontal plane is located between a projection of the opening on the horizontal plane and a projection of a point of rotation of the swing lever on the horizontal plane, and allowing extracting and retracting of the hose through the opening, wherein the first roll moves through an arcuate path during extraction and retraction of the hose through the opening.

13. The method according to claim 12, wherein applying a return force on the hose via the first roll comprises applying a return force on the hose via the first roll towards the housing.

14. A fuel dispensing unit for refueling vehicles comprising at least one hose handling apparatus, the hose handling apparatus comprising:

a hose housing comprising an interior volume, a fuel supply connection adapted to convey a vehicle fuel to a hose, and a first roll and a second roll arranged in the housing, said hose housing having an opening for the hose, said hose in successive order being connected to the fuel supply connection, passing by the first roll, passing by the second roll and extending through the opening towards a nozzle end of the hose, wherein said first roll has a predetermined lowermost position in an upper half of the interior volume of the hose housing and is attached to the housing by at least one resilient element and a first carrier part having the form of a rotatable lever, and wherein a projection of the first roll on a horizontal plane is located between a projection of the hose opening on the horizontal plane and a projection of a point of rotation of the swing lever on the horizontal plane, said second roll being attached to the housing in a vertically fixed position by at least a second carrier part, the first and second rolls adapted to allow extraction and retraction of at least a portion of the hose through the opening, wherein the first roll moves through an arcuate path during extraction and retraction of the portion of the hose through the opening.

15. A fuel dispensing unit according to claim 14, wherein the resilient element is either of a spring and an elastomeric string.

16. A fuel dispensing unit according to claim 14, wherein the rotatable lever is arranged to vary the distance between the first roll and the second roll, when extracting and retracting of the hose through the opening.

17. A fuel dispensing unit according to claim 14, wherein movement of the first roll is independent of any movement of the second roll when extracting and retracting of the hose through the opening.

18. A fuel dispensing unit according to claim 14, wherein a first part of the hose is arranged between the fuel supply connection and the second roll, and a second part of the hose is arranged between the second roll and the nozzle end of the hose, the second part of the hose being, when the hose is in its retracted position, at least 30% longer than the first part of the hose.

19. A fuel dispensing unit according to claim 14, the second roll being attached to the housing in a vertically and horizontally fixed position in relation to the housing by at least the second carrier part.

* * * * *